US007634892B2

(12) United States Patent
Ausnit

(10) Patent No.: US 7,634,892 B2
(45) Date of Patent: Dec. 22, 2009

(54) METHOD OF MANUFACTURING RECLOSABLE PACKAGING HAVING TAMPER-EVIDENT FEATURE

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 61 days.

(21) Appl. No.: 11/714,455

(22) Filed: Mar. 6, 2007

(65) Prior Publication Data

US 2007/0151210 A1 Jul. 5, 2007

Related U.S. Application Data

(60) Division of application No. 11/195,116, filed on Aug. 2, 2005, now Pat. No. 7,185,475, which is a continuation-in-part of application No. 10/747,849, filed on Dec. 29, 2003, now Pat. No. 6,941,726.

(51) Int. Cl.
*B65B 61/18* (2006.01)
*B31B 1/90* (2006.01)

(52) U.S. Cl. ..... 53/412; 53/455; 383/5; 383/64; 493/213

(58) Field of Classification Search ..... 53/133.4, 53/139.2, 412, 455, 562; 493/213, 927; 383/5, 383/64; *B65B 61/18; B31B 1/90*
See application file for complete search history.

(56) References Cited

U.S. PATENT DOCUMENTS 4,337,889 A * 7/1982 Moertel ..... 383/210.1
4,682,366 A 7/1987 Ausnit et al. ..... 383/65
4,927,271 A * 5/1990 Branson ..... 383/5
5,456,928 A * 10/1995 Hustad et al. ..... 426/87
5,713,669 A * 2/1998 Thomas et al. ..... 383/204
6,088,887 A * 7/2000 Bois ..... 24/399
6,257,763 B1 * 7/2001 Stolmeier et al. ..... 383/5
6,273,607 B1 8/2001 Buchman ..... 383/5
6,290,390 B1 9/2001 Buchman ..... 383/5
6,347,885 B1 2/2002 Buchman ..... 383/5
6,360,513 B1 3/2002 Strand et al. ..... 53/412
6,474,866 B2 11/2002 Buchman ..... 383/5
6,632,021 B2 * 10/2003 Bois et al. ..... 383/59
6,799,890 B2 * 10/2004 Schneider et al. ..... 383/210
6,829,873 B2 12/2004 Kinigakis et al. ..... 53/133.4
6,884,208 B2 4/2005 Haws ..... 493/213
6,962,034 B2 * 11/2005 Thieman ..... 53/133.4
7,107,738 B2 9/2006 Ausnit et al. ..... 53/412

(Continued)

*Primary Examiner*—Stephen F Gerrity
(74) *Attorney, Agent, or Firm*—Ostrager Chong Flaherty & Broitman P.C.

(57) ABSTRACT

Methods of manufacturing reclosable packages having a slider-operated string zipper covered by a tamper-evident shroud that is provided with at least one opening that at least partially exposes the slider. In accordance with one method, openings are formed in a web of packaging material that is folded, placed over the slider-operated string zipper, and attached to the receptacle walls to form a shroud. Preferably, the openings are sized, shaped and situated so that they frame the slider on both sides of the shroud. In accordance with another method, a reclosable package having a slider-operated string zipper and a shroud with openings that at least partially expose the slider can be formed using a single web of packaging material that is folded and sealed to form a shroud that covers the string zipper.

13 Claims, 6 Drawing Sheets

U.S. PATENT DOCUMENTS

| | | | | |
|---|---|---|---|---|
| 7,114,309 | B2 * | 10/2006 | Ausnit | 53/412 |
| 7,178,309 | B2 * | 2/2007 | Thomas et al. | 53/133.4 |
| 2003/0041563 | A1 * | 3/2003 | Schneider et al. | 53/412 |
| 2003/0145558 | A1 | 8/2003 | Schneider et al. | 53/412 |
| 2003/0208989 | A1 * | 11/2003 | Thomas et al. | 53/412 |
| 2003/0235347 | A1 * | 12/2003 | Kinigakis et al. | 383/5 |
| 2004/0091178 | A1 * | 5/2004 | Schneider | 383/61.2 |
| 2005/0008267 | A1 * | 1/2005 | Linton et al. | 383/64 |
| 2005/0120678 | A1 * | 6/2005 | Ausnit | 53/412 |
| 2006/0003879 | A1 | 1/2006 | Buchman | 493/213 |

* cited by examiner

METHOD OF MANUFACTURING RECLOSABLE PACKAGING HAVING TAMPER-EVIDENT FEATURE

This application is a divisional of and claims priority from U.S. patent application Ser. No. 11/195,116 filed on Aug. 2, 2005, issued on Mar. 6, 2007 as U.S. Pat. No. 7,185,475, which in turn is a continuation-in-part application of and claims priority from U.S patent application Ser. No. 10/747,849 filed on Dec. 29, 2003, issued on Sep. 13, 2005 as U.S. Pat. No. 6,941,726.

BACKGROUND OF THE INVENTION

This invention generally relates to the provision of tamper-evident features in reclosable packaging. In particular, the invention relates to tamper-evident features for use in reclosable packaging of a type having a slider-operated string zipper.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened.

Reclosable bags typically comprise a receptacle having a mouth with a zipper for opening and closing the mouth. In recent years, many zippers have been designed to operate with a slider mounted thereto. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interengageable profiled closure strips that are joined at opposite ends of the bag mouth. The profiles of interengageable plastic zipper strips can take on various configurations, e.g. interlocking rib and groove elements having so-called male and female profiles, interlocking alternating hook-shaped closure elements, interlocking ball-shaped closure elements, etc. Reclosable bags having slider-operated zippers are generally more desirable to consumers than bags having zippers without sliders because the slider eliminates the need for the consumer to align the interengageable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag-making film, for example, by conduction heat sealing. These separate closure strips typically have flanges extending therefrom in such a way that the flanges can be joined to bag-making film in order to attach the closure strips to the film. Many previous slider-operated, separately extruded zippers used flange-type constructions.

An alternative zipper design is the so-called flangeless or string zipper, which has substantially no flange portion above or below the interengageable closure profiles. In the case of a string zipper, the bag-making film is joined to the backs of the bases of the closure strips. String zippers can be produced at much greater speeds, allow much greater footage to be wound on a spool, thereby requiring less set-up time, and use less material than flanged zippers, enabling a substantial reduction in the cost of manufacture and processing.

Various additions to reclosable bags have been made to provide tamper-evident seals or indicators that will reveal when the bag has been opened or otherwise tampered with prior to purchase by the consumer. It is known to provide a reclosable package construction that is designed to undergo some permanent change in the package appearance when the package is opened for the first time. For example, it is known to provide a reclosable package with a tamper-evident, non-reclosable peel seal that gives a positive indication of having been broken when a package is first opened. It is also known to shroud the zipper (with or without slider) inside an enclosed header on the top of the bag. Another type of tamper-evident feature is the provision of a membrane on the product side of the zipper that partitions the interior volume in an airtight manner.

U.S. Pat. No. 6,347,885 discloses a reclosable package having a slider-operated flanged zipper shrouded by a tamper-evident structure. An opening in one or both walls of the tamper-evident structure provides a view of the slider. Optionally, the openings may encircle the slider, with the perimeters of the openings serving to block movement of the slider in the opening direction. Additional tamper-evident structure may be provided in the form of a peel seal (between the bag panels or between the zipper flanges) or in the form of a web that, in effect, connects the zipper flanges to form a membrane, each of these optional features serving to block access to the product even after the zipper has been opened. U.S. Pat. No. 6,347,885 is silent regarding providing tamper-evident features on a reclosable package having a slider-operated string (i.e., flangeless) zipper.

There is a need for new designs for slider-operated string-zippered reclosable packages with tamper-evident features that can be manufactured at low cost.

BRIEF DESCRIPTION OF THE INVENTION

The present invention is directed to methods of manufacturing reclosable packages comprising a slider-operated string zipper covered by a tamper-evident shroud having an opening that at least partially exposes the slider.

One aspect of the invention is a method of manufacture comprising the following steps: (a) placing first and second portions of a length of a first web on opposing sides of a volume of space; (b) prior or subsequent to the performance of step (a), joining the first portion of the length of the first web to a back of a length of a first flangeless zipper strip having a first closure profile on its front, thereby forming a first zone of first joinder; (c) prior or subsequent to the performance of step (a), joining the second portion of the length of the first web to a back of a length of a second flangeless zipper strip having a second closure profile on its front, thereby forming a second zone of joinder, respective major portions of the first and second closure profiles of the respective lengths of the first and second zipper strips being interlockable with each other; (d) inserting a slider onto the lengths of the first and second flangeless zipper strips, the first portion of the length of the first web passing between the back of the length of the first flangeless zipper strip and a first sidewall of the slider, and the second portion of the length of the first web passing between the back of the length of the second flangeless zipper strip and a second sidewall of the slider; (e) subsequent to the performance of steps (a) through (d), joining a first portion of a length of a second web to a third portion of the length of the first web disposed lower than the first portion of the length of the first web, thereby forming a third zone of joinder; (f) subsequent to the performance of steps (a) through (d), joining a second portion of the length of the second web to a fourth portion of the length of the first web disposed lower than the second portion of the length of the first web, thereby forming a fourth zone of joinder; and (g) prior or subsequent to the performance of step (e), removing a third portion of the length of the second web to form an opening that is situated so that at least a portion of the slider is exposed through the opening after steps (a) through (f) have been performed.

Another aspect of the invention is a method of manufacture comprising the following steps: (a) placing first and second portions of a length of a first web on opposing sides of a volume of space; (b) before or after step (a), joining a back of a length of a first flangeless zipper strip to the first portion of the length of the first web, the length of the first flangeless zipper strip being substantially the same as the length of the first web; (c) before or after step (a), joining a back of a length of a second flangeless zipper strip to a second portion of the length of the first web, the length of the second flangeless zipper strip being substantially the same as the length of the first web; (d) inserting a slider on the lengths of the first and second flangeless zipper strips after completion of steps (a) through (c); (e) joining third and fourth portions of the length of the first web to each other along a first band-shaped zone of joinder that is substantially transverse to the length of the first flangeless zipper strip; (f) joining fifth and sixth portions of the length of the first web to each other along a second band-shaped zone of joinder that is substantially parallel to the first band-shaped zone of joinder, the first and second band-shaped zones of joinder forming side boundaries of a pocket; (g) loading product into the pocket; (h) joining a first portion of a length of a second web to a seventh portion of the length of the first web along a third band-shaped zone of joinder that is substantially parallel to and disposed lower than the length of the first flangeless zipper strip; (i) joining a second portion of the length of the second web to an eighth portion of the length of the first web along a fourth band-shaped zone of joinder that is substantially parallel to and disposed lower than the length of the second flangeless zipper strip; and (j) prior or subsequent to the performance of step (h), removing a third portion of the length of the second web to form an opening that is situated so that at least a portion of the slider is exposed through the first opening after steps (a) through (j) have been performed.

A further aspect of the invention is a method of manufacture comprising the following steps: (a) folding a length of a web having first and second parallel edges along first, second and third folds that are substantially parallel to the first and second edges, the folded web comprising a first portion extending from the first fold to the second fold, a second portion extending from the second fold to the third fold, the first and second portions confronting each other, a third portion extending from the first fold, and a fourth portion extending from the third fold, wherein no portion of the third and fourth portions is disposed between the first and second portions; (b) joining a back of a length of a first flangeless zipper strip and a portion of the third portion of the length of the web that is near or adjacent the first fold to an intervening portion of the first portion of the length of the web that is near or adjacent the first fold, thereby forming a first double-layer seal; (c) joining a back of a length of a second flangeless zipper strip and a portion of the fourth portion of the length of the web that is near or adjacent the third fold to an intervening portion of the second portion of the length of the web that is near or adjacent the third fold, thereby forming a second double-layer seal; (d) inserting a slider onto the lengths of the first and second flangeless zipper strips, the first double-layer seal passing between the back of the length of the first flangeless zipper strip and a first sidewall of the slider, and the second double-layer seal passing between the back of the length of the second flangeless zipper strip and a second sidewall of the slider; (e) joining respective distal portions of the third and fourth portions of the length of the web to each other to form a shroud that covers the first and second flangeless zipper strips and the slider; and (f) prior or subsequent to the performance of step (e), forming an opening in the third portion of the length of the web that is situated so that the slider is exposed through the opening after steps (a) through (f) have been performed.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
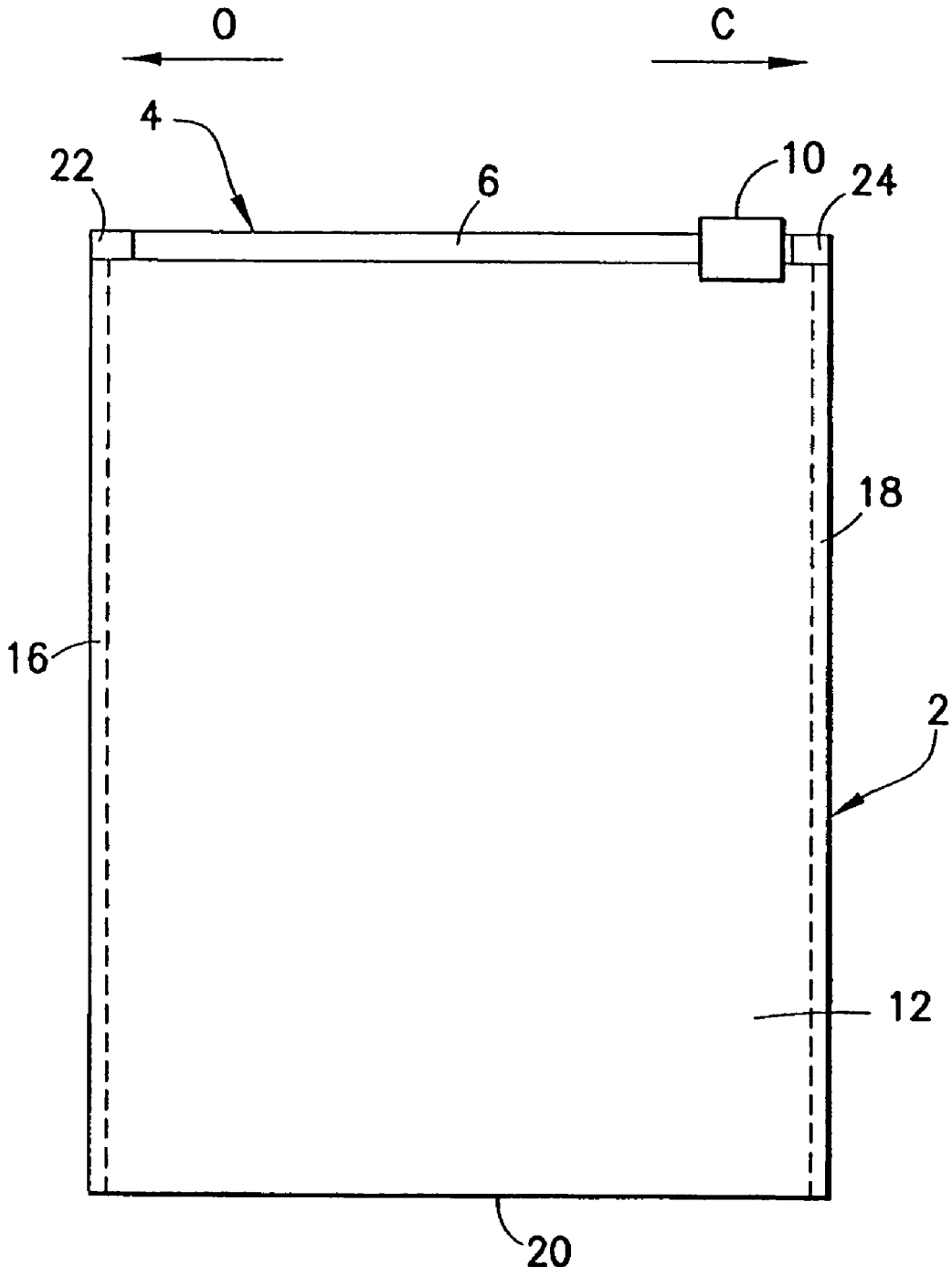
FIG. 1 PRIOR ART
FIG. 1 is a drawing showing a frontal view of a known reclosable package having a slider-operated string zipper.

A known reclosable package comprising a receptacle 2 and a flexible plastic string zipper 4 operated by manipulation of a slider 10 is shown in FIG. 1. This exemplary package is of the so-called "pillow pouch" variety. However, it should be understood that the methods of manufacture disclosed herein can be applied to reclosable packages of the type shown in FIG. 1 or other types of reclosable packages having a different structure, such as thermoformed packages.

The receptacle 2 may be made from any suitable film material, including thermoplastic film materials such as low-density polyethylene, substantially linear copolymers of ethylene and a C3-C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less. The receptacle 2 comprises opposing walls (only the front panel 12 is visible in FIG. 1) that may be secured together at opposite side edges of the receptacle by seams 16 and 18 (indicated by dashed lines). The opposing bottoms of the walls may be joined, for example, by means of a heat seal made in conventional fashion, e.g., by application of heat and pressure. Typically, however, the bottom of the package is formed by a fold 20 in a web of packaging material, as depicted in FIG. 1.

At its top end, the receptacle 2 has an openable mouth, on the inside of which is an extruded plastic string zipper 4. The string zipper 4 comprises a pair of interengageable zipper strips. One zipper strip 6 is visible in FIG. 1. The profiles of the zipper strips may take any form. For example, the string zipper may comprise interlocking rib and groove elements or alternating hook-shaped closure elements or combinations thereof. The preferred zipper material is polyethylene. The upper margins of the front and rear bag walls are respectively sealed to the backs of the respective zipper strips by a conventional conduction heat sealing technique.

The string zipper is operated by sliding the slider 10 along the zipper strips. As the slider moves across the zipper, the zipper is opened or closed. As shown in FIG. 1, the slider is slidable along the zipper in a closing direction "C", causing the zipper strips to become engaged, or in an opening direction "O", causing the zipper strips to become disengaged. Although not visible in FIG. 1, the slider 10 is of the type having a plow or separating finger for prying the closure profiles of the zipper apart as the slider is moved in the opening direction. FIG. 1 shows the slider 10 in a parked position corresponding to the zipper being fully closed.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The package shown in FIG. 1 further comprises end stops 22 and 24 for preventing the slider from sliding off the end of the zipper when the slider reaches the zipper closed or fully opened position. Such end stops perform dual functions, serving as stops to prevent the slider from going off the end of the zipper and also holding the two zipper profiles together to prevent the receptacle from opening in response to stresses applied to the profiles through normal use of the bag. In the embodiment shown in FIG. 1, the end stops comprise stomped areas on the zipper strips themselves. The stomped end stops comprise sections of the zipper strips that have been fused together and flattened at the ends of the zipper. Alternatively, slider end stop structures could be attached to the zipper strips.

Figure 2:
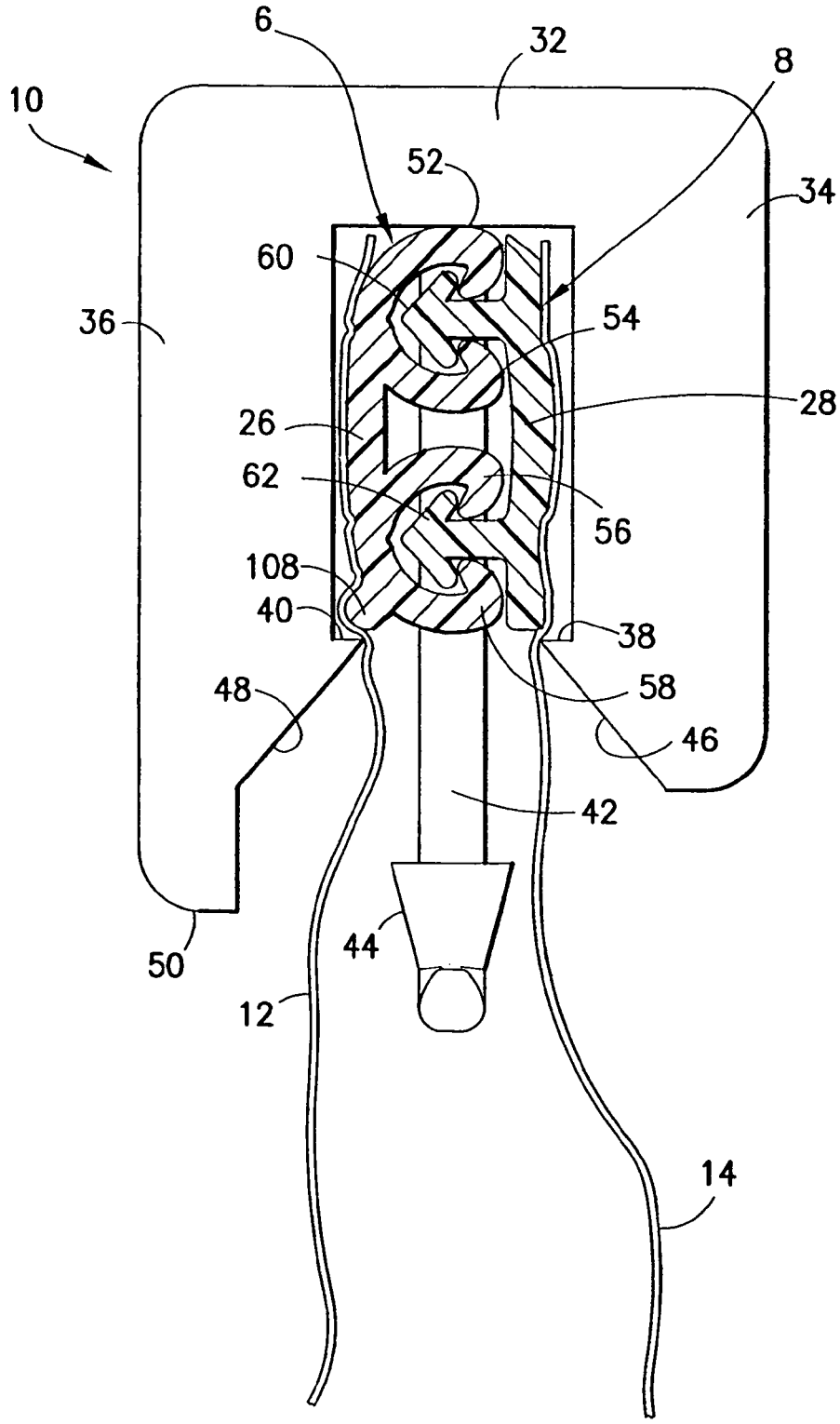
FIG.2 PRIOR ART
FIG. 2 is a drawing showing a sectional view of the zippered mouth of a slider-operated reclosable package.

A string zipper design in accordance with one embodiment of the present invention is depicted in FIG. 2. This string zipper comprises a pair of flangeless zipper strips 6 and 8, each of which is an extruded plastic part having a generally constant profile along its length. The backs of the flangeless zipper strips 6, 8 are joined to the marginal portions of respective walls 12, 14 (shown in part) of the receptacle, and a slider 10 having a separating finger or plow 42 is mounted to the string zipper with the joined portions of the receptacle walls 12, 14 passing between the slider sidewalls 34 and 36.

One embodiment of a string zipper suitable for use in the present invention is seen in FIG. 2. Numerals 12 and 14 indicate opposing walls (made, e.g., of plastic film) of a receptacle. The marginal portions of the walls 12 and 14 of the receptacle are joined to the zipper parts 6 and 8, e.g., by heat sealing. The zipper in this example is an extruded plastic structure comprising mutually interlockable profiled zipper parts 6 and 8. Zipper part 8 comprises a base 28 and two generally arrow-shaped rib-like male closure elements or members 60 and 62 projecting therefrom, while zipper part 6 comprises two pairs of hook-shaped gripper jaws connected by a sealing bridge 26. The pairs of gripper jaws form respective complementary female profiles for receiving the male profiles of closure elements 60 and 62. More specifically, jaws 52 and 54 receive and interlock with the male element 60, while jaws 56 and 58 receive and interlock with the male element 62. Alternatively, one zipper part could have a single male profile, while the other zipper part has a single female profile. In accordance with further alternatives, one zipper part could have one male profile and one female profile, while the other zipper part has one female profile and one male profile, or the respective zipper parts could each have more than two male or female profiles.

Still referring to FIG. 2, the sealing bridge 26 and the base 28 are resiliently flexible self-supporting structures having a thickness greater than the thickness of the bag film. The male closure elements are integrally formed with the base 28, while the female closure elements are integrally formed with the sealing bridge 26. The upper margins of the walls 12 and 14 of the bag are joined to the backs of the sealing bridge 26 and the base 28 respectively. The upper margins of the bag film may have short free ends that extend beyond the termination points depicted in FIG. 2, provided that the free ends are not so long as to interfere with travel of the slider along the zipper or become entangled with the zipper profiles.

In a typical zipper, the profile of each male member has a stem flanked by shoulders or teeth, and a tip of the profile points toward the opposing female profile, the tip being the point of the male member furthest away from the base of the profiled structure. Each female profile comprises a pair of gripper jaws extending from a base or root of the female profile. Each jaw comprises a wall and a hook integrally formed at the distal end of the respective wall. The hooks are inclined and generally directed toward each other, the distal ends of the hooks defining a mouth that communicates with a groove defined by the walls and root of the female profile. To open the closed zipper, the zipper parts 6 and 8 are pried apart with sufficient force to pull the heads of the male members out of the female profiles. When the shoulders of the male members clear the hooks of the outwardly flexed gripper jaws, the male and female members are no longer interlocked and the zipper is open.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile.

As seen in FIG. 2, the slider 10 for opening or closing the reclosable zipper is generally shaped so that the slider straddles the zipper profiles. The slider 10 shown in FIG. 2 is fully disclosed in U.S. patent application Ser. No. 10/367,450 and comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The upper margins of the bag walls 12 and 14, which are joined to the backs of the zipper parts 6 and 8, are disposed between the respective zipper parts and the respective side walls 34 and 36 of the slider. The width of the tunnel is substantially constant along the section that is divided by the plow and then narrows from a point proximal to the end of the plow to the closing window at one end face of the slider. The narrowing section of the tunnel is formed by the substantially planar, inclined interior surfaces (not shown in FIG. 2), which converge toward the closing window of the slider. These inclined surfaces funnel or squeeze the zipper parts toward each other, causing the zipper profiles to interlock, as the slider is moved in the closing direction.

The slider 10 also comprises a plow or divider 42 that depends downward from a central portion of the top wall 32 to an elevation below the lowermost portions of each sidewalls. The plow is disposed between opposing sections of the zipper parts that pass through the tunnel. In the embodiment shown in FIG. 2, a wedge-shaped body 44 is disposed near the distal end of the plow 42. However, the wedge-shaped body is optional. The width of the wedge shape of increases linearly toward the slider top wall 32. The tip of the plow 42 is truncated and has rounded edges and flattened corners at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper parts 6 and 8 apart. The plow 42 divides the closing end of the slider tunnel into respective passages for the separated zipper parts to pass through.

The slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper parts to increase slider pull-off resistance. The ledges 38 and 40 further comprise respective inclined bottom surfaces 46 and 48 that serve to guide the respective zipper parts 6 and 8 into the slider tunnel during automated insertion of the slider onto the zipper.

To reduce the cost of manufacture, the slider may be designed to reduce the amount of material used and to increase the speed with which such sliders can be injection molded. Suitable injection-molded slider designs are fully disclosed in U.S. Patent Application Publ No. 2004/0161169.

Figure 3:
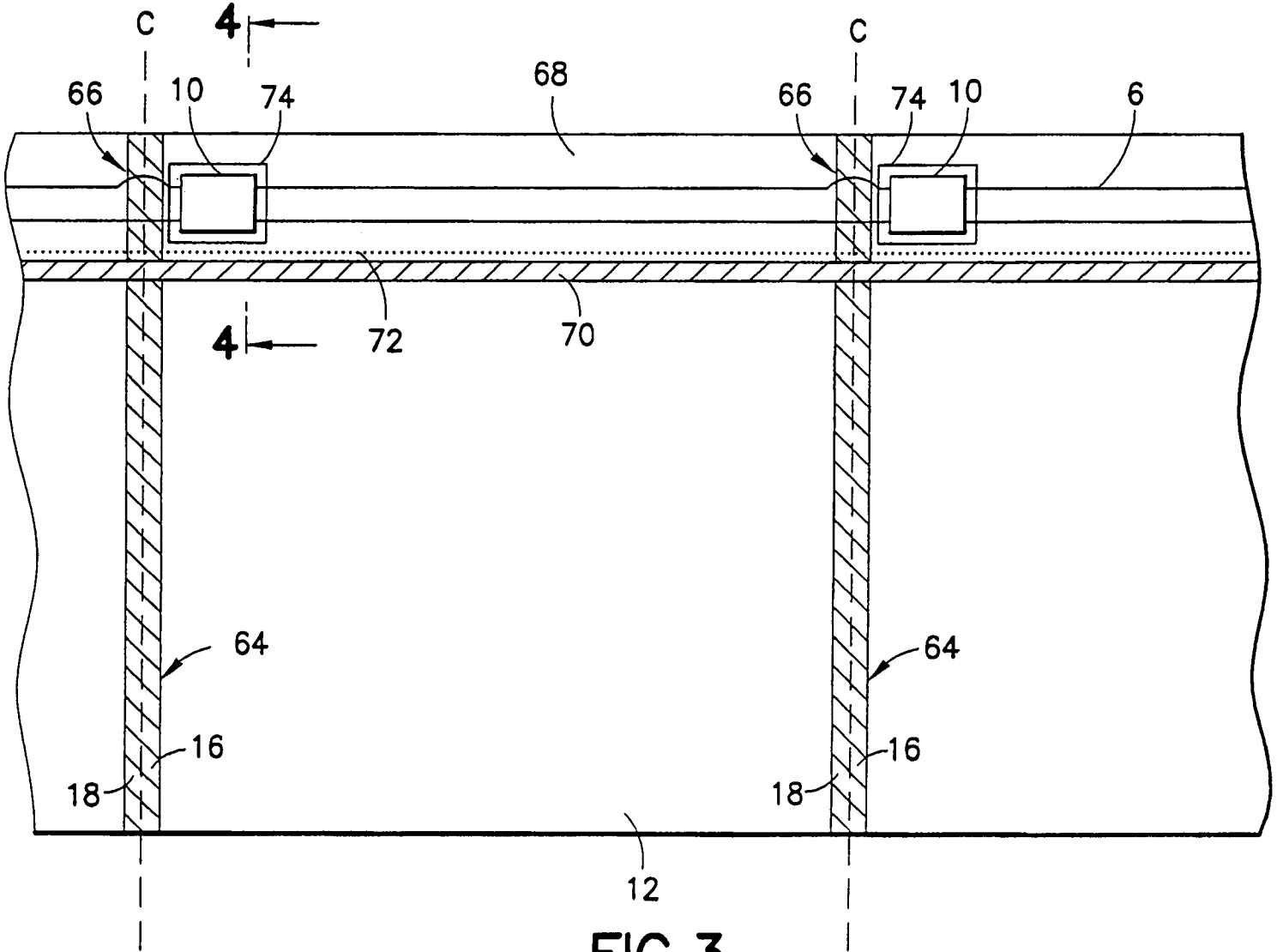
FIG. 3 is a drawing showing a frontal view of a portion of a folded web of packaging material having a slider-operated string zipper attached inside and a shroud attached outside, the shroud being a folded web of packaging material with openings for exposing the sliders in accordance with one embodiment of the invention. The work in process is shown at a stage after filling of the reclosable package precursor and before the latter is cut along the vertical lines C to form an individual package.
Figure 4:
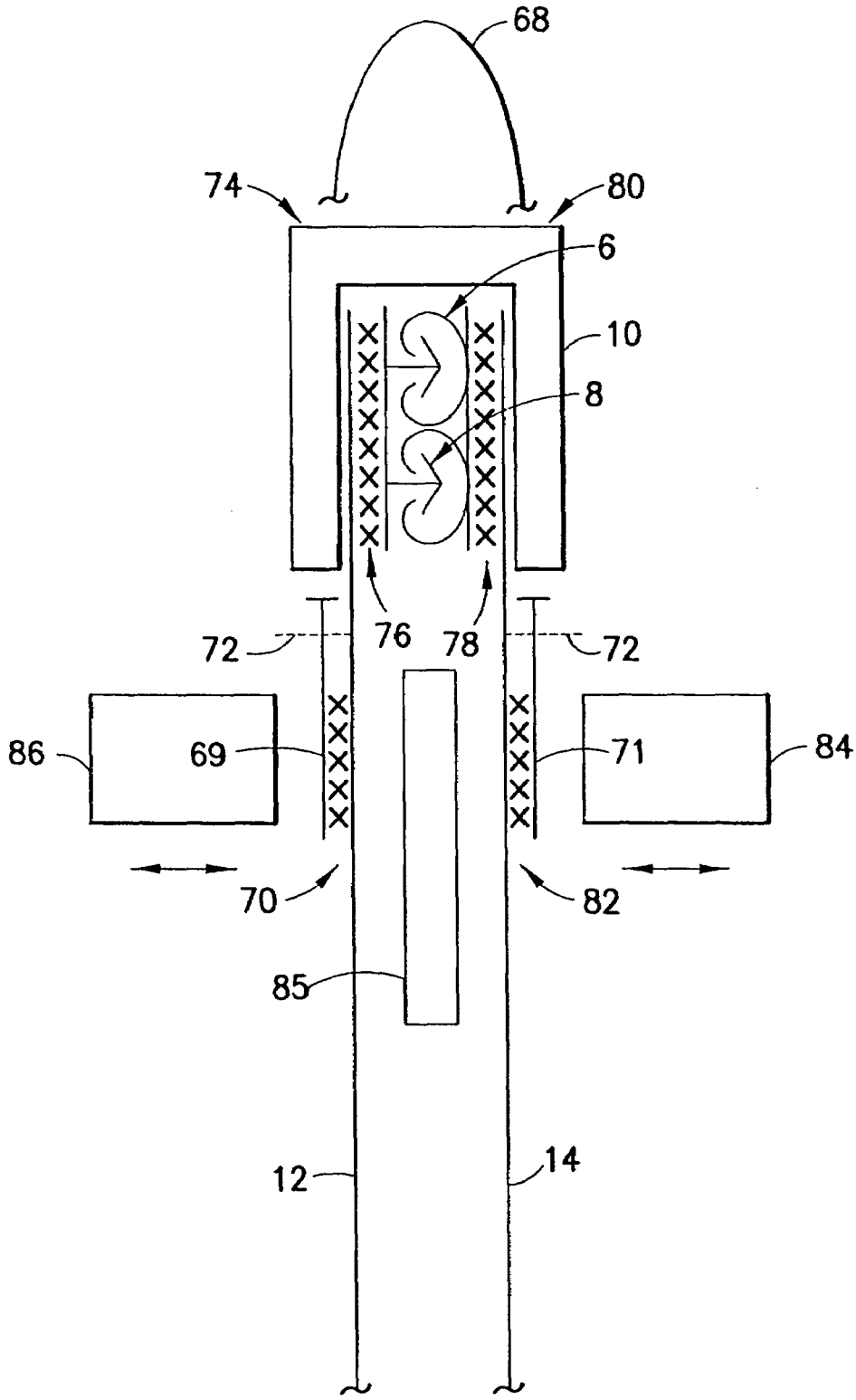
FIG. 4 is a drawing showing a sectional view of a reclosable package precursor after the formation of heat seals that join the shroud to the web, the section being taken along line 4-4 indicated in FIG. 3.

In accordance with one embodiment of the present invention shown in FIGS. 3 and 4, the confronting marginal portions of a folded web of packaging material that forms the walls 12 and 14 of a chain of connected package precursors are joined to the respective backs of a pair of flangeless zipper strips 6 and 8 in respective band-shaped zones 76 and 78. FIG. 4 shows a sectional view of a reclosable package precursor, the section being taken along line 4-4 indicated in FIG. 3. After the string zipper has been joined to the walls 12 and 14, a slider 10 is inserted. Thereafter, a tamper-evident shroud 68 in the form of a strip-shaped web of packaging material is folded and attached to the respective walls 12 and 14 at elevations that are lower than the elevations of the respective band-shaped zones of web-zipper joinder 76 and 78. One side or wall 69 of the shroud 68 is joined to the wall 12 in a band-shaped zone 70 indicated by a column of X's in FIG. 4. The other side or wall 71 of the shroud 69 is joined to the wall 14 in a band-shaped zone 82 depicted in a similar manner in FIG. 4. Typically, each zone of joinder is formed by applying sufficient heat and pressure to cause abutting surfaces of respective layers of thermoplastic material to soften or melt and then fuse together upon cooling, thereby forming a so-called "permanent" seal because it is designed to remain intact during normal usage of the package. In that sense, zones of joinder 70, 76, 78 and 82 are permanent seals.

FIG. 4 shows a pair of heating sealing bars 84 and 86 that have been retracted after the permanent seals 70 and 82 have been formed. To prevent seal-through of the receptacle walls 12 and 14, a separating plate 85 may be disposed between the walls 12 and 14 and between the opposing reciprocatable sealing bars 84 and 86. The separating plate prevents the wall 12 from contacting the wall 14 when the heated sealing bars 84 and 86 are in their extended positions. Alternatively, the inner surfaces of the portions of walls 12 and 14 involved in the formation of permanent seals 70 and 82 may have a coating of non-sealant material, with the outer surfaces of the walls 12 and 14 being made of a sealant material designed to seal with the shroud walls during the heat sealing operation.

In accordance with the embodiment shown in FIGS. 3 and 4, each package-length section of the shroud web 68 has a respective pair of openings 74 and 80 that are shaped, sized and situated so that the perimeters of the openings frame a respective slider 10. These openings are preferably formed in the shroud web before the latter is attached to the bag web, but in the alternative, the openings could be formed afterward. Optionally, only the front side or wall of the shroud 68 is provided with cutouts for exposing the sliders. Optionally, one or both walls of the shroud can be tack sealed to the confronting zipper strip or strips in an area near the opening end of the slider 10 to prevent the slider from being moved in the opening direction so long as the shroud is in place.

An individual package can be separated from the rest of the work in process by cutting along the vertical lines indicated by dashed lines C in FIG. 3. Each cut line C bisects a respective cross seal 64, which extends from the top of the shroud to the bottom of the receptacle, and a respective slider end stop structure 66, which is formed by applying ultrasonic wave energy to the string zipper using a horn and/or an anvil that have appropriately shaped recesses for receiving and shaping the softened or molten thermoplastic material of the zipper. A pair of lines of weakened tear resistance 72 (only one of which is visible in FIG. 3) are provided at an elevation lower than and parallel to the string zipper for facilitating removal of a major portion of the shroud 68, thereby exposing the slider and the string zipper. Each tear line 72 may take the form of a series of tiny perforations arranged at short intervals along a horizontal line. However, any other conventional line of weakened tear resistance may be employed. For example, the tear lines 72 may be formed by laser scoring.

In accordance with one embodiment, the cross seals 64 are formed in two stages. In the first operation (performed before the receptacle is filled with product and after the string zipper has been attached), the walls 12 and 14 are joined to each in the portion of the cross seal 64 that extends from the string zipper to the bottom fold. In the second operation (performed after the receptacle has been filled with product and after the shroud 68 has been attached to the walls 12 and 14), the walls of the shroud are joined to each other in the portion of the cross seal 64 that extends above the string zipper and are joined to the receptacle walls in the portion of the cross seal 64 that extends from the top of the string zipper to the zone of joinder 70. Each cross seal 64 is bisected along a respective cut line C to form the left side seam 16 of one package and the right side seam 18 of an adjacent package.

Figure 5:
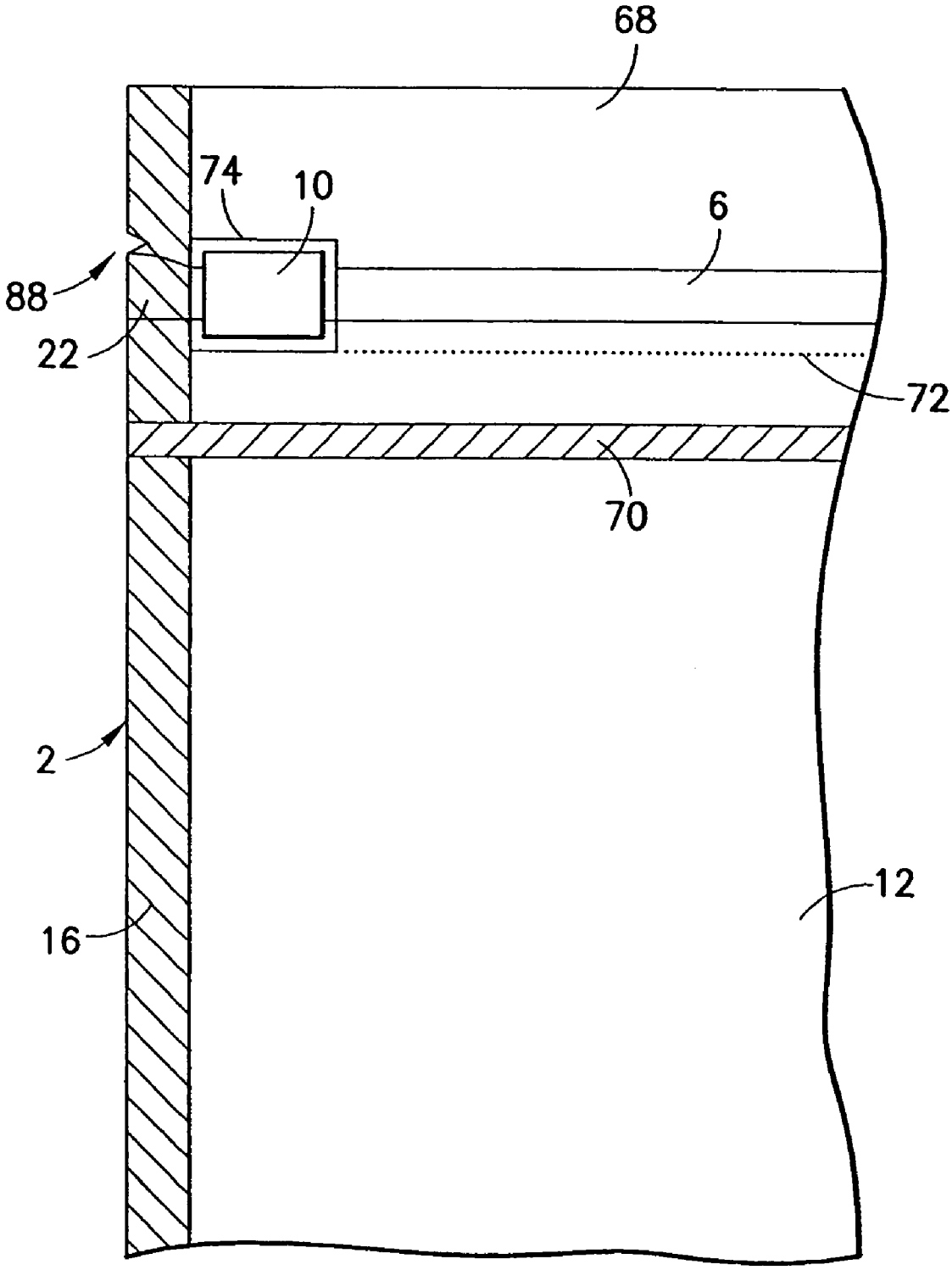
FIG. 5 is a drawing showing a sectional view of a portion of a completed reclosable package in accordance with one embodiment of the present invention.

FIGS. 3 and 4 depict the tear line 72 as being disposed at an elevation below the string zipper and slightly below the bottom of the opening 74. However, it is preferable that the tear line 72 be disposed at the elevation of the bottom of the rectangular opening 74, as seen in FIG. 5, which shows the upper left-hand corner of a completed package. In the embodiment depicted in FIG. 5, a tear notch 88 is formed in the edge of the side seam 16 at the elevation of the top of the rectangular opening 74. The portion of the side seam 16 disposed above the tear notch 88 then serves as a pull tab that is pulled across the package to initiate tearing of the side seam 16 at the apex of the tear notch 88. After the portion of the side seam from the apex of the tear notch 88 to the nearest corners of the rectangular openings (only opening 74 is visible in FIG. 5) has been completely torn, continued pulling of the tab causes the respective tear lines (only tear line 72 is visible in FIG. 5) to tear at the opposing corner of the respective rectangular opening, and then further tearing of the tear lines until the major portion of the shroud disposed above the tear lines is torn off, thereby exposing the slider and the string zipper.

The reclosable package depicted in FIG. 5 can be manufactured by the following process. A web of packaging material (e.g., a web of thermoplastic film) is drawn from a supply roll and pulled forward in a substantially horizontal plane. At the same time, a continuous ribbon or tape of closed string zipper is unwound from a supply reel or spool and laid along the edge of the horizontal web by a guide roller. The string zipper, comprising interlocked flangeless zipper strips, is guided into a position parallel to and adjacent or nearly adjacent to an edge of the web by a zipper guide. The web is then joined to the back of the adjoining first zipper strip by means of a reciprocatable heated sealing bar at a first sealing station. The heated sealing bar melts or softens the thermoplastic material of the web and/or the zipper strip in a band-shaped zone, which melted or softened thermoplastic then fuses upon cooling to form a permanent seal. Alternatively, the zipper may be applied by a continuous sealing operation with the continuous movement of the zipper being translated into intermittent movement by dancing bars.

The web with attached string zipper along one edge is then pulled by a pair of side rollers past a folding board. The side rollers may be provided with grooves to provide clearance for the string zipper. The folding board folds the web to form two folded sides interconnected by a folded section and disposed substantially vertical, with the folded section at the bottom. During folding, the string zipper and the marginal portion of the web that is not yet joined to the zipper are guided by conventional means into respective positions such that the string zipper and that marginal portion of the web confront each other.

Immediately after the web is folded, the flangeless zipper strips are joined to each other at spaced intervals (i.e., zones of zipper fusion having centerlines separated by a distance equal to one package length) by any conventional means, such as an ultrasonic welding assembly comprising an anvil and a reciprocatable horn that transmits ultrasound wave energy into the zipper material. The horn and anvil can be designed to shape the thermoplastic zipper material into a structure that will also serve as respective slider end stops on two separate packages when the shaped area is later bisected during severance of a package. During the same operation, a confronting portion of the marginal portion of web not yet attached to the string zipper is joined to the adjoining second zipper strip in the same region.

At the next station, the two sides of the folded web are joined to each other at the location of the end seals, e.g., by conventional heat sealing using reciprocatable vertical sealing bars. One or both of the vertical sealing bars are heated. The heated sealing bar applies heat in a band-shaped zone having a centerline that is oriented substantially perpendicular to string zipper. When the web material cools, it fuses to form a cross seal indicated by the hatched zone 64 in FIG. 3. Successive cross seals, in combination with the fold at the bottom of the folded web, form a respective pocket that is not closed at the top. Each pocket is then opened to allow the pocket to be loaded with product by means of a filling device, such as a funnel. The pocket may be opened by conventional means, such as a pair of reciprocatable vacuum cups. To open the mouth of the pocket, first the vacuum cups are extended, then suction is provided to the cups. The vacuum cups are then retracted while suction is being applied. The suction holds respective portions of the folded sides of the web against the vacuum cups as the latter are retracted, causing the mouth of the pocket to open. Product from the funnel is dropped through the open mouth (i.e., through a space between the unattached zipper strip and adjoining portion of the web) and into the interior volume of the pocket.

After product has been loaded into a pocket, the top of the pocket is released from its fully open state by turning off the suction to the vacuum cups to release the two sides of the folded web. The filled pocket is then advanced to a second sealing station where the confronting portion of the unattached marginal portion of the web is joined to the second zipper strip. This can be accomplished, e.g., by conventional heat sealing using reciprocatable horizontal sealing bars. The sealing bar that confronts the second zipper strip is heated, while the opposing sealing bar that confronts the first zipper strip need not be heated. The horizontal sealing bars in their extended positions will press the unattached marginal portion of the web against the back of the second zipper strip, producing a band-shaped zone of zipper/web joinder after the melted or softened thermoplastic material of the zipper and/or web has fused. At this juncture, the filled pocket is closed.

Downstream from the second sealing station, excess web material that extends beyond the zipper is continuously trimmed by a pair of stationary knives. Each knife trims a respective marginal portion of the web that extends beyond the tops of the zipper. The tips of the knife blades must be positioned so as to not cut the zipper, even as the moving zipper wanders to and fro. The trimmed portions of the web are taken away. Unattached tail portions at the web cut lines may remain after cutting. The presence of unattached tails could interfere with slider insertion during manufacture as well as with slider operation during use of the reclosable package by a consumer. Therefore an additional step is performed of sealing the tails to the respective zipper strips. The tails are sealed by a lip sealer, e.g., of the type disclosed in U.S. Patent Application Publ No. 2005/0043159.

The filled pocket is then advanced to a slider insertion station, where a slider insertion device inserts a slider onto the string zipper. A typical slider insertion device for inserting a slider onto a closed zipper comprises a pusher that pushes a slider onto a section of the string zipper in a slider insertion zone. The pusher displacement is driven by an air cylinder. The pusher is fixed to a distal end of a rod of a piston slidable inside the cylinder. The pusher is alternately extended and retracted by actuation of the air cylinder, which has two separate ports (not shown) for intake of compressed air from separately controlled air lines. The pusher travels along a straight tunnel or channel. One sidewall of the channel has an opening that communicates with the end of a slider track (not shown). A succession of sliders are fed periodically along the track by a conventional pneumatic slider feeding system (not shown). When the pusher is retracted, the next slider must be automatically fed to a pre-insertion position directly in front of the pusher.

Systems for transporting sliders to a slider insertion device are disclosed in U.S. patent application Ser. No. 10/106,687 filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 2 has one leg (i.e., side wall) longer than the other, to wit, an extension 50 of side wall 36 projects to an elevation lower than the bottom edge of the opposing side wall 34. The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

At the same time that a slider is being inserted as previously described, a slider end stop structure is being formed on the zipper at an ultrasonic stomping station downstream from the slider insertion zone. This slider end stop structure will be bisected later during cutting by a hot knife (not shown) to form two slider end stops, i.e., the end stop at the zipper fully closed slider park position for one package and the end stop at the zipper fully open slider park position for the next package. The end stop structure is typically formed by an ultrasonic stomping assembly comprising a horn and an anvil. The horn transmits sufficient ultrasound wave energy into the plastic zipper material that the material is fused into a structure (e.g., a vertically extending hump) defined by the surfaces of the horn and anvil. The horn and anvil may be of the reciprocating or rotary variety.

After the package has been filled and the slider has been inserted onto the string zipper, a second web of packaging material (narrower than the first web) is drawn from a supply roll and pulled forward in a substantially horizontal plane. The second web is advanced intermittently, each advance being substantially equal to one package length. During each dwell time, a pair of openings are formed in the second web at a fixed station, the openings of each pair being disposed in mirror-image fashion on opposite sides of the centerline of the second web. Each opening is sized and shaped so that a slider will fit inside and be framed by the opening. In the example shown in FIG. 3, the openings are rectangular. The openings may be formed by cutting with a blade or a laser or by punching. In addition, respective tear lines are formed on opposing sides of and parallel with the centerline of the second web. As seen in FIG. 5, the tear lines 72 may be aligned with one side of the respective rectangular openings 74. Each tear line may be formed by punching a series of tiny perforations, spaced at equal intervals along a respective straight line that extends parallel with the web centerline from one corner of the respective rectangular opening to a corner of the corresponding one of the next pair of rectangular openings. Alternatively, the tear lines may extend along the entire length of each package-length section of the second web, as seen in FIG. 3.

The section of the second web with openings formed therein is pulled by a pair of side rollers past a folding board. The folding board folds the second web in half along its centerline to form two folded sides interconnected by a folded section and disposed substantially vertical, with the folded section at the top. During folding, the marginal portions of the second web are guided by conventional means into respective positions such that the marginal portions of the second web and the marginal portions of the first web confront each other. The openings on the second web are situated so that each pair of openings will be aligned with a respective slider on the string zipper. After each section of the second web has been folded with its openings aligned with a slider, the marginal portions of that section of the second web are joined to the respective marginal portions of the corresponding section of the first web by any conventional means, such as horizontal heated sealing bars 84 and 86 depicted in FIG. 4.

In the alternative, the openings 74 may be formed after the second web has been attached to the first web to form the shroud 68.

After the shroud is in place, the cross seals 64 are extended to the top of the shroud 68 by heat sealing the two sides of the second web to each other at elevations higher than the slider end stop structure 66 and by heat sealing the two sides of the second web to the first web at lower elevations down to the band-shaped zones of joinder (items 70 and 82 in FIG. 4).

Thereafter each cross seal 64 is cut, e.g., along a centerline C (see FIG. 3), by a cutting instrument, such as a blade, to sever a package from the remaining work in process. Optionally, a conveyor belt placed below the filled pocket can be used to move the filled pockets forward to the cutting station. The finished package lands on a take-off belt, which conveys the package to a collection area. Before the next package in the chain is advanced and severed from the work in process, a tear notch (item 88 in FIG. 5) is formed in the edge of the left end seal of the shroud 68.

Because the openings in the shroud allow anyone to grasp the slider and pull it in the opening direction, preferably means are provided to prevent the slider from being moved in that direction. For example, the relative dimensions of the cross sections of the shroud and the slider may be selected so that it is not possible to fit the slider between the walls of the shroud adjacent the opening end of the parked slider. Alternatively, the shroud walls may be tack sealed together in the area adjacent the cutouts in a manner that again prevents the slider from entering between the shroud walls adjacent the opening end of the parked slider. The slider could also be tack sealed to the shroud.

Figure 10:
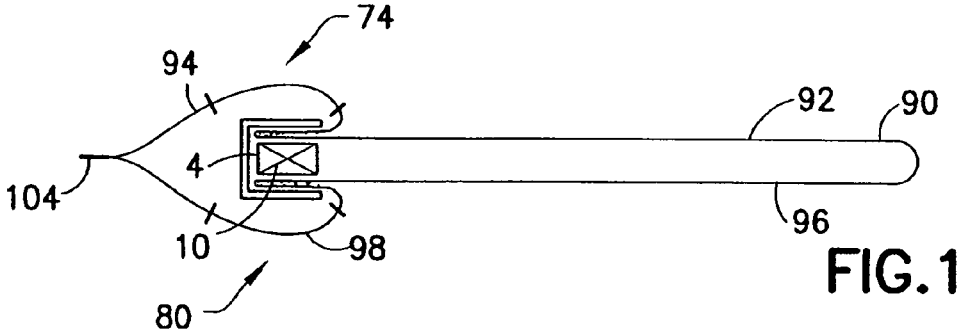

In accordance with another embodiment of the invention, a reclosable package having openings in the shroud that expose the slider can be manufactured by a method comprising the steps depicted in FIGS. 6-10. The receptacle and the shroud can be formed from a single web of packaging material that is folded three times instead of once. Prior to the folding of each package-length section of the web, a pair of openings 74 and 80 (the extents of which are indicated by short lines that cross the web in FIGS. 6-10) are formed on opposite sides of the web centerline. The openings are sized, shaped and situated so that they will at least partially expose a respective slider in the finished package, as is depicted in FIG. 10. Alternatively, the openings are sized, shaped and situated so that they will frame a respective slider in the finished package.

Figure 6:
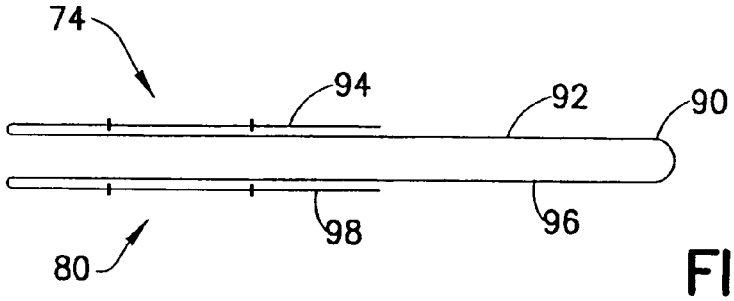
FIGS. 6-10 are drawings showing respective stages in the manufacture of a reclosable package in accordance with another embodiment of the present invention.

As shown in FIG. 6, a web 90 of film material with preformed opening 74 and 80 is folded along three fold lines to form a serpentine profile comprising a pair of inner legs 92 and 96, and a pair of outer legs 94 and 98. The outer leg 94 is connected to the inner leg 92 at the first fold line; the inner leg 92 is connected to the inner leg 96 at the second fold line; and the inner leg 96 is connected to the outer leg 98 at the third fold line. The opening 74 is situated on the outer leg 94, while the opening 80 is situated on the outer leg 98.

Figure 7:
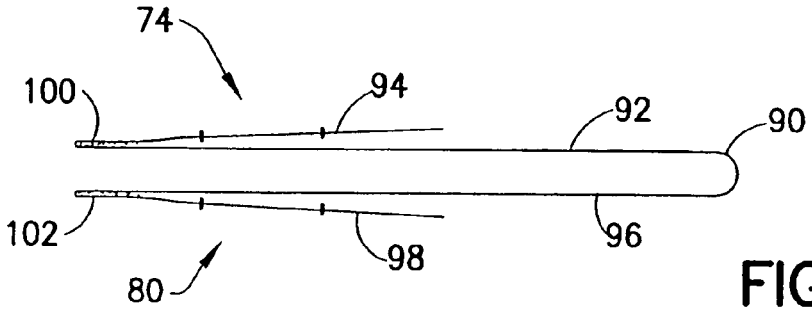
Figure 8:
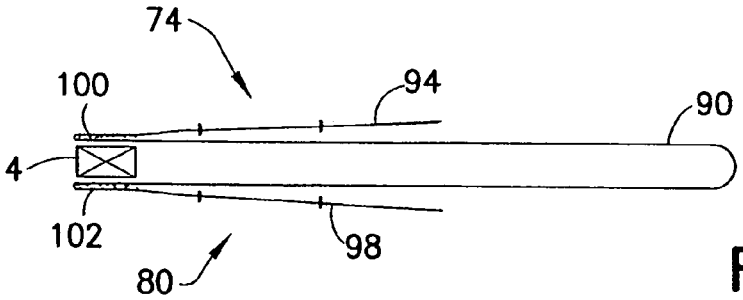
Figure 9:
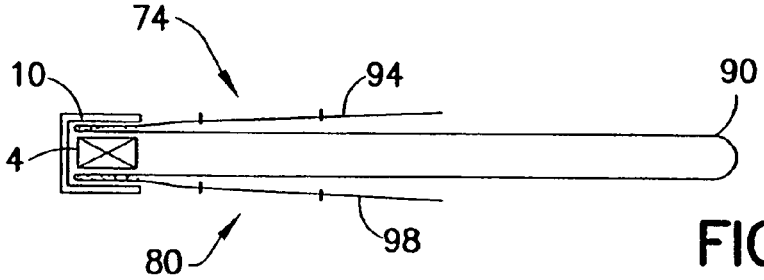

Referring to FIG. 7, the confronting portions of outer leg 94 and inner leg 92 proximal to the first fold line are heat sealed together to form a merged double layer of film 100; likewise the confronting portions of outer leg 98 and inner leg 96 proximal to the third fold line are heat sealed together to form a merged double layer of film 102. In the next step, a string zipper 4 is placed between the respective merged portions 100 and 102, and the latter are respectively joined (e.g., by heat sealing) to opposite sides of the string zipper (i.e., the bases of respective complementary flangeless zipper strips), as seen in FIG. 8. Alternatively, the interlocked zipper can be attached to one of the inner legs before the second fold line is made, or the zipper parts can be separately attached to their respective inner legs. Then a slider is inserted over the string zipper and the film material joined thereto (see FIG. 9). The outer legs 94 and 98 are then folded over the zipper so that the marginal portions of the outer legs are in confronting relationship. The confronting marginal portions of outer legs 94 and 98 are then heat sealed to form a fin seal 104 (see FIG. 10). The resulting shroud can be open at both ends or, if a hermetic seal is desired, sealed shut at both ends. Thereafter, the assembly shown in FIG. 10 can be cross sealed and cut along a transverse line to sever a finished package from the work in progress.

In a horizontal form-fill-seal machine, product can be placed on the web of film material 90 before the web is folded. Alternatively, after the package shown in FIG. 10 has been completed, the film can be slit at the second fold line to allow the product to be loaded through the bottom of the package, after which the slit is resealed. In accordance with yet another alternative wherein the web/zipper assembly is vertically disposed, the zipper can be opened and product can be loaded into the receptacle through the open mouth after zipper application and slider insertion, but before the top of the shroud is sealed closed.

Although not shown in FIG. 10, a respective line of weakened tear resistance can be formed in each outer leg 94, 98, the lines being parallel to the zipper and below the slider, to facilitate removal of the shroud by a consumer. Each line of weakened tear resistance may comprise a series of spaced perforations (for non-hermetic headers) or a scoreline (for hermetic headers). The lines of weakened tear resistance can be formed in the web 90 before or after the shroud is formed. Additionally, the shroud could be provided with a hang hole.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising interengageable zipper strips that have substantially no flange portions. As used in the claims, the term "lower than" is used with reference to an upright reclosable package in which the zipper is higher than the product-filled receptacle. Finally, in the absence of explicit language setting forth the order in which certain steps should be performed, the method claims should not be construed to require that steps be performed in the order in which they are recited.

The invention claimed is:

1. A method of manufacture comprising the following steps:

(a) placing first and second portions of a length of a first web on opposing sides of a volume of space;

(b) prior or subsequent to the performance of step (a), joining said first portion of said length of said first web to a back of a length of a first flangeless zipper strip having a first closure profile on its front, thereby forming a first zone of joinder;

(c) prior or subsequent to the performance of step (a), joining said second portion of said length of said first web to a back of a length of a second flangeless zipper strip having a second closure profile on its front, thereby forming a second zone of joinder, respective major portions of said first and second closure profiles of said respective lengths of said first and second zipper strips being interlockable with each other;

(d) inserting a slider onto said lengths of said first and second flangeless zipper strips, said first portion of said length of said first web passing between said back of said length of said first flangeless zipper strip and a first sidewall of said slider, and said second portion of said length of said first web passing between said back of said length of said second flangeless zipper strip and a second sidewall of said slider;

(e) placing a separating plate between third and fourth portions of said length of said first web, said third portion of said length of said first web being disposed lower than said first portion of said length of said first web, while said fourth portion of said length of said first web is disposed lower than said second portion of said length of said first web;

(f) subsequent to the performance of steps (a) through (e), concurrently joining a first portion of a length of a second web to said third portion of said length of said first web to form a third zone of joinder and joining a second portion of said length of said second web to said fourth portion of said length of said first web to form a fourth zone of joinder, a portion of said second web extending above said slider after completion of step (f); and (g) prior or subsequent to the performance of step (f), removing a third portion of said length of said second web to form a first opening that is situated so that at least a portion of said slider is exposed through said first opening after steps (a) through (f) have been performed.

2. The method as recited in claim 1, wherein said first opening is sized, shaped and situated so that said slider can fit within a perimeter of said first opening after steps (a) through (f) have been performed, as a result of which said first opening frames said slider.

3. The method as recited in claim 2, further comprising the step, performed prior or subsequent to step (f), of removing a fourth portion of said length of said second web to form a second opening that is sized, shaped and situated so that said slider can fit within a perimeter of said second opening after steps (a) through (f) have been performed, as a result of which said second opening frames said slider.

4. The method as recited in claim 3, further comprising the step of forming first and second lines of weakened tear resistance in said length of said second web, wherein subsequent to the performance of all steps heretofore recited, said first line of weakened tear resistance extends from a first location adjacent said first opening to a second location further away from said first opening, and said second line of weakened tear resistance extends from a third location adjacent said second opening to a fourth location further away from said second opening.

5. The method as recited in claim 1, further comprising the step of, prior or subsequent to the performance of step (f), forming a line of weakened tear resistance in said length of said second web that extends from a first location adjacent said first opening to a second location further away from said first opening.

6. The method as recited in claim 1, further comprising the following steps:

joining said first and second flangeless zipper strips together in fifth and sixth zones of joinder having respective centerlines separated by a distance equal to one package length;

joining fifth and sixth portions of said length of said first web together along a seventh zone of joinder that extends generally transverse to said first zone of joinder;

joining seventh and eighth portions of said length of said first web together along an eighth zone of joinder that extends generally parallel to said seventh zone of joinder, said seventh and eighth zones of web joinder having respective centerlines separated by a distance equal to one package length and generally aligned with the centerlines of said fifth and sixth zones of joinder respectively, said seventh and eighth zones of joinder forming respective side boundaries of a pocket; and cutting said respective lengths of said first and second flangeless zipper strips and said first and second webs along first and second transverse lines that respectively intersect said seventh and eight zones of joinder.

7. The method as recited in claim 6, further comprising the step of filling said pocket with product before (f) has been performed.

8. The method as recited in claim 6, further comprising the steps of joining fourth and fifth portions of said length of said second web together along a ninth zone of joinder having a centerline that is generally collinear with the centerline of said seventh zone of joinder.

9. The method as recited in claim 8, further comprising the step of forming a tear notch or a line of weakened tear resistance in said ninth zone of joinder.

10. A method of manufacture comprising the following steps:

(a) placing first and second portions of a length of a first web on opposing sides of a volume of space;

(b) before or after step (a), joining a back of a length of a first flangeless zipper strip to said first portion of said length of said first web, the length of said first flangeless zipper strip being substantially the same as the length of said first web;

(c) before or after step (a), joining a back of a length of a second flangeless zipper strip to a second portion of said length of said first web, the length of said second flangeless zipper strip being substantially the same as the length of said first web;

(d) inserting a slider on said lengths of said first and second flangeless zipper strips after completion of steps (a) through (c);

(e) joining third and fourth portions of said length of said first web to each other along a first band-shaped zone of joinder that is substantially transverse to said length of said first flangeless zipper strip;

(f) joining fifth and sixth portions of said length of said first web to each other along a second band-shaped zone of joinder that is substantially parallel to said first band-shaped zone of joinder, said first and second band-shaped zones of joinder forming side boundaries of a pocket;

(g) placing product in said volume of space;

(h) placing a separating plate between seventh and eighth portions of said length of said first web, said seventh portion of said length of said first web being substantially parallel to and disposed lower than said length of said first flangeless zipper strip, while said fourth portion of said length of said first web is substantially parallel to and disposed lower than said length of said second flangeless zipper strip;

(i) concurrently joining a first portion of a length of a second web to said seventh portion of said length of said first web to form a third band-shaped zone of joinder and joining a second portion of said length of said second web to said eighth portion of said length of said first web to form a fourth band-shaped zone of joinder, a portion of said second web extending above said slider after completion of step (i); and (j) prior or subsequent to the performance of step (i), removing a third portion of said length of said second web to form a first opening that is situated so that at least a portion of said slider is exposed through said first opening after steps (a) through (j) have been performed.

11. The method as recited in claim 10, wherein said first opening is sized, shaped and situated so that said slider can fit within a perimeter of said first opening after steps (a) through (j) have been performed, as a result of which said first opening frames said slider.

12. The method as recited in claim 11, further comprising the following step:

(k) prior or subsequent to the performance of step (i), removing a fourth portion of said length of said second web to form a second opening that is sited, shaped and situated so that said slider can fit within a perimeter of said second opening after steps (a) through (k) have been performed, as a result of which said second opening frames said slider.

13. The method as recited in claim 11, further comprising the steps of cutting said respective lengths of said first and second flangeless zipper strips and said first and second webs along first and second transverse lines that respectively intersect said first and second zones of joinder.

* * * * *